US008474376B2

(12) United States Patent
Dumenil

(10) Patent No.: US 8,474,376 B2
(45) Date of Patent: Jul. 2, 2013

(54) PRINTING DEVICE, ADJUSTMENT METHOD AND PRINTING METHOD

(75) Inventor: Frànçois Dumenil, Chaumes en brie (FR)

(73) Assignee: Machines Dubuit, Noisy le Grand (FR)

( * ) Notice: Subject to any disclaimer, the term of this patent is extended or adjusted under 35 U.S.C. 154(b) by 727 days.

(21) Appl. No.: 12/209,630

(22) Filed: Sep. 12, 2008

(65) Prior Publication Data

US 2009/0071352 A1 Mar. 19, 2009

(30) Foreign Application Priority Data

Sep. 12, 2007 (FR) ..... 07 57520

(51) Int. Cl.
*B05C 17/04* (2006.01)

(52) U.S. Cl.
USPC ..... 101/123; 101/38.1

(58) Field of Classification Search
USPC ..... 101/114, 123, 124, 126, 127.1, 129, 101/35, 38.1
See application file for complete search history.

(56) References Cited

U.S. PATENT DOCUMENTS

| | | | | | |
|---|---|---|---|---|---|
| 2,198,565 | A | * | 4/1940 | Schutz et al. | 101/124 |
| 3,109,365 | A | * | 11/1963 | Karlyn | 101/124 |
| 3,113,510 | A | | 12/1963 | Dubuit | |
| 4,463,671 | A | * | 8/1984 | Rudolph et al. | 101/35 |
| 5,158,016 | A | * | 10/1992 | Dubuit | 101/123 |
| 6,223,653 | B1 | | 5/2001 | Christ | |
| 2003/0154868 | A1 | * | 8/2003 | Mcevoy et al. | 101/127.1 |

FOREIGN PATENT DOCUMENTS

| | | | |
|---|---|---|---|
| DE | 196 14 740 | A1 | 10/1997 |
| EP | 0 700 781 | A2 | 3/1996 |
| GB | 2 203 695 | A | 10/1988 |
| GB | 2 360 014 | A | 9/2001 |
| NL | 1002118 | | 7/1997 |

* cited by examiner

*Primary Examiner* — Ren Yan
(74) *Attorney, Agent, or Firm* — Young & Thompson

(57) ABSTRACT

A device for printing via screen printing an object which has a conical portion, the device includes a frame, a screen which can be moved relative to the frame, elements for rotatably driving the screen about a rotation axis, including a single motor, first members for moving the motor, the first members, extending in a first direction, second members for moving the motor, the second members extending in a second direction perpendicular relative to the first direction, the first members carrying the second members.

20 Claims, 7 Drawing Sheets

PRINTING DEVICE, ADJUSTMENT METHOD AND PRINTING METHOD

FIELD OF THE INVENTION

The present invention relates to a device for printing a conical object by means of screen printing.

BACKGROUND OF THE INVENTION

There is known, in particular from document U.S. Pat. No. 6,223,653, a printing device which comprises a frame, means for rotatably driving the object relative to the frame, a screen which carries a pattern to be printed, and a screen support which is carried by the frame. Two toothed rings are arranged at two opposite sides of the screen. These rings are engaged in two racks which extend opposite each other on the screen support. This rack drive is capable of causing the screen to pivot about the centre thereof and moving it in a first direction relative to the frame. Other driving means are arranged on the frame in order to move the screen support relative to the frame in a second direction which is perpendicular relative to the first direction. During the printing operation, the screen is moved in order to describe an arc of a circle whose centre is the centre of conicity of the object.

However, this printing device is complex and the operation thereof is complicated.

An object of the present invention is to provide a more simple printing device.

SUMMARY OF THE INVENTION

To this end, the invention relates to a device for printing by means of screen printing an object which has at least a conical portion, the conical portion having a centre of conicity and an angle of conicity, the device comprising:

a frame;

a screen which can be moved relative to the frame, the screen carrying a mesh which has a pattern to be printed on the conical portion of the object, the pattern having the shape of a conical evolute which has a pattern centre and an angular extent range of the pattern;

a squeegee which is carried by the frame, the squeegee being capable of pressing the mesh of the screen against the conical portion of the object in order to apply the pattern to the conical portion of the object, the device comprising:

means for rotatably driving the screen about a rotation axis, the means for rotatably driving the screen comprising a single motor, first means for moving (first displacement means) the motor for rotatably driving the screen, the first movement means extending in a first direction, second means for moving the motor (second displacement means) for rotatably driving the screen, the second movement means extending in a second direction perpendicular relative to the first direction, the first movement means (first displacement means) carrying the second movement means (second displacement means).

According to specific embodiments, the printing device comprises one or more of the following features:

the first movement means comprise a first slotted member which is fixedly joined to the frame and a first carriage which is guided in the first slotted member, the second movement means comprising a second slotted member which is carried by the first carriage and a second carriage which is guided in the second slotted member, the second carriage carrying the means for rotatably driving the screen;

the first movement means and the second movement means each comprise a single motor for movably driving the first carriage and second carriage, respectively;

the device comprises a reversible mechanical connection between the motor for movably driving the first carriage and the first carriage, and a reversible mechanical connection between the motor for movably driving the second carriage and the second carriage;

the device comprises a reversible mechanical connection between the motor for driving in terms of rotation and the screen, the motor for driving in terms of rotation and the motors for driving in terms of movement are reversible:

the device further comprises means for rotatably driving the object relative to the frame at a predefined angular speed and the motor for rotatably driving the screen is capable of causing the screen to pivot at an angular speed which is dependent only on the angle of conicity of the object and the angular rotation speed of the object;

the first carriage and the second carriage are moved over a path whose length depends only on the position of the centre of conicity of the conical portion of the object and the angular extent range of the pattern; and the first displacement means and second displacement means are capable of allowing the first carriage and the second carriage to be moved manually relative to the frame in the first direction and second direction, respectively, the means for rotatably driving the screen being capable of allowing the screen to pivot manually about the rotation axis, and the device comprises:

means for reading the position of the first carriage, the position of the second carriage and the rotation angle of the screen at a Cartesian reference point which is fixed relative to the frame, calculation means which are capable of calculating, from the positions read, the coordinates of the movement path of the first carriage and the second carriage and the rotation angles of the screen at the Cartesian reference point, and control means which are capable of controlling the movement of the first carriage, the second carriage and the rotation of the screen in accordance with the coordinates and the angles calculated.

Prior to the printing operation, the printing device must be adjusted so that the printing is carried out precisely on the portion of the object that is intended for this purpose. This adjustment is difficult to implement since there are discrepancies in terms of position between the theoretical position of the pattern relative to the screen and the clearances between the screen and the movement means of the screen. Furthermore, this adjustment must be modified each time an object having a different shape or size has to be printed.

Another object of the present invention is to provide an easier adjustment method for the printing device mentioned above.

To this end, the invention relates to an adjustment method of the type comprising:

a) a learning phase which involves the following steps:

moving the first carriage and the second carriage in the first direction X and the second direction Y, respectively, and causing the screen to pivot in order to superimpose a portion of the pattern over part of the conical portion;

reading the position coordinate of the first carriage, the position coordinate of the second carriage and the orientation angle of the screen at the Cartesian reference point;

the learning phase being carried out for three different parts of the pattern;

b) a phase for calculating the coordinates of the movement path of the first carriage and the second carriage from the coordinates and the angles read during the learning phase.

According to specific embodiments, the adjustment method comprises one or more of the following features:

during the learning phase, an initial point, a final point and an intermediate point are defined, the initial point being located at an initial end of the pattern, the final point being located at a final end of the pattern, the intermediate point being located between the initial end and final end of the pattern, the three points extending along an arc of a circle centred on the centre of the pattern, and the first carriage and second carriage and the screen are moved so as to arrange the centre of the pattern and a defined point in a vertical plane which contains the axis of revolution of the object;

the calculation phase involves the following steps:

calculating the coordinates of the centre of rotation of the output shaft of the motor for rotatably driving the screen at the Cartesian reference point and the radius of rotation of the output shaft of the motor for rotatably driving the screen about this centre of rotation;

calculating the coordinates of the movement path of the first carriage and the second carriage at the Cartesian reference point based on the following formulae:

$$X(t)=x0+R\times\cos\left[(A(t)-A1)+A0\right]$$

$$Y(t)=y0+R\times\sin\left[(A(t)-A1)+A0\right]$$

where:

X(t), Y(t) are the coordinates of the movement path of the first carriage and the second carriage at the Cartesian reference point, t being varied over time, x0, y0 are the coordinates of the centre of rotation of the output shaft of the motor for rotatably driving the screen at the Cartesian reference point, R is the radius of rotation of the output shaft of the motor for rotatably driving the screen about the centre of rotation, A0 is the angle defined between the axis of the Cartesian reference point and a straight line which extends through the centre of rotation and the coordinates, A(t) is the angle of rotation of the output shaft of the drive motor at time t, with A being varied over time over an angular sector which is equal to the angular sector of the angular extent range of the pattern, A1 is the angle of orientation of the screen recorded when a portion located at an initial end of the pattern is superimposed over a part of the conical portion which is intended to receive it; and x1, y1 are the coordinates which are recorded when the portion located at one end of the pattern is superimposed over the part of the conical portion.

The invention also relates to a printing method which involves the steps of the adjustment method described above.

The adjustment method and the printing method can be used by any printing device which comprises a frame, a screen which can be moved relative to the frame, a squeegee which is carried by the frame and at least two means for driving the screen in two perpendicular directions.

BRIEF DESCRIPTION OF THE DRAWINGS

The invention will be better understood from a reading of the description, given purely by way of example and with reference to the drawings, in which.

DETAILED DESCRIPTION OF THE PREFERRED EMBODIMENT

Figure 1:
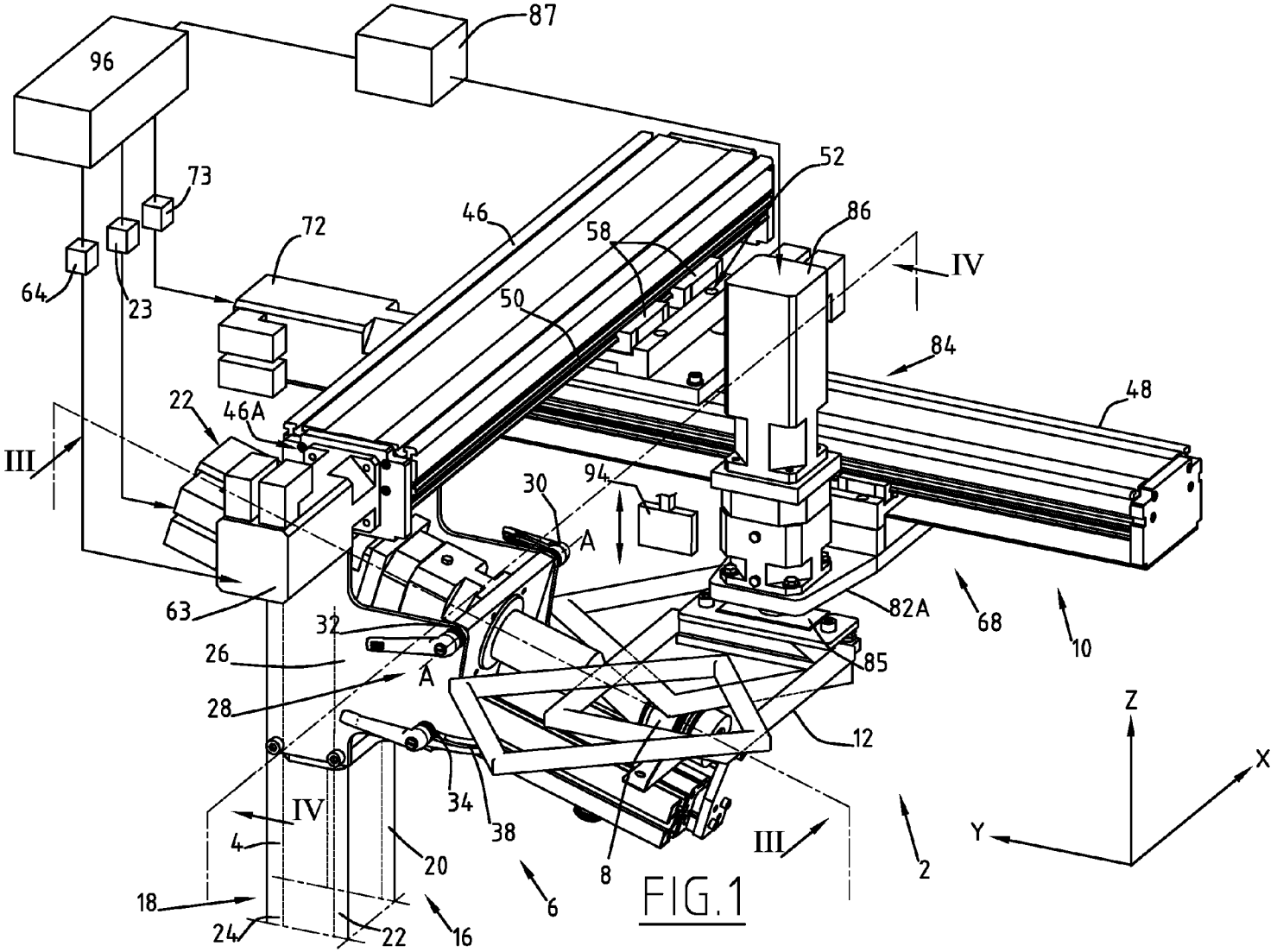
FIG. 1 is a perspective view of the printing device according to the invention.

The printing device 2 according to the invention is illustrated in FIG. 1. It comprises a frame 4 which carries a device 6 for rotatably driving an object 8 to be printed, and a system 10 for moving a printing screen 12.

Figure 2:
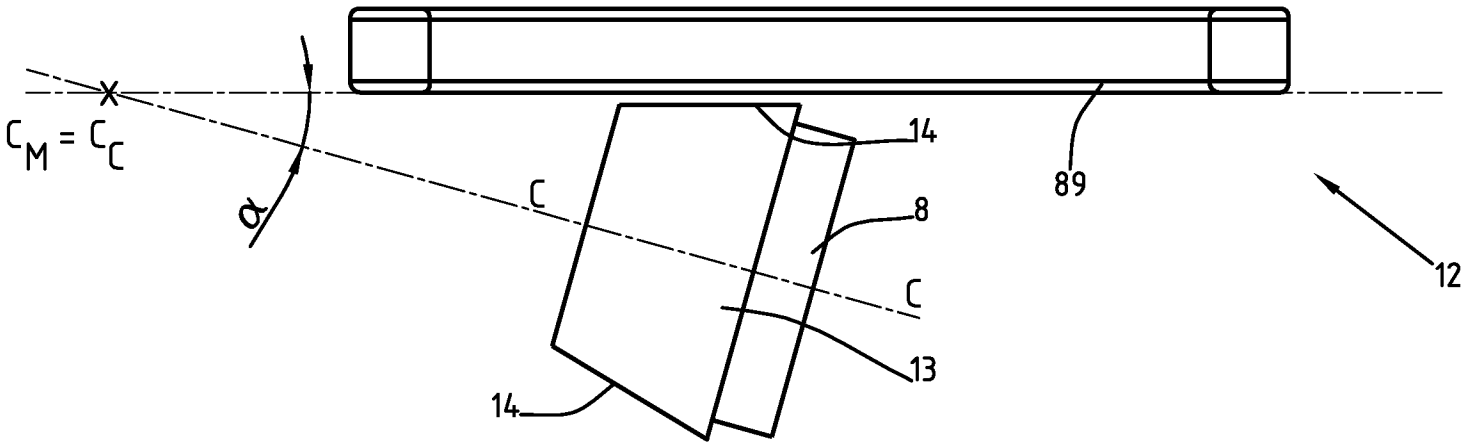
FIG. 2 is a side view of the screen and the object to be printed.

According to the invention, the object 8 to be printed has at least a conical portion 13 which has a centre of conicity $C_c$ and an angle of conicity a illustrated in FIG. 2. The centre of conicity $C_c$ is located at the virtual apex of the conical portion. The angle of conicity $\alpha$ is the angle defined between a generating line 14 of the cone and the axis of revolution C-C of the cone.

The frame 4 of the printing device has a generally parallelepipedal shape which is open at one of the faces 16 thereof, referred to below as the front face, and on the opposite face 18 thereof, referred to below as the rear face.

The internal lateral faces of the frame 4 are provided with four vertical rails 20, 22, 24 on which the drive device 6 is capable of moving in order to modify the distance between the object 8 to be printed that it carries and the screen 12 in accordance with the diameter of the object 8 to be printed. The paths of the guiding walls of the rails 22 and 24 are illustrated with dotted lines in FIG. 1.

The frame 4 is further provided with means (not illustrated) for locking the device 6 in a vertical position.

The drive device 6 is constituted by a housing 26, a motor/step-down motor assembly 27 which is carried by the housing 26 and a system 28 for cam locking and retaining the motor/step-down motor assembly 27.

The housing 26 forms a cradle which is open at the front and rear faces thereof. It is provided with rollers which are engaged in the vertical rails 20, 22, 24 of the frame 4.

The motor/step-down motor assembly 27 is capable of causing the object to be printed to be pivoted about the axis of revolution C-C thereof, at a predefined angular speed Wo. It is provided with an encoder 23 which is illustrated schematically in FIG. 1 and which is capable of reading the angular position of the object.

The motor/step-down motor assembly 27 can be pivoted relative to the housing 26 about an axis A-A which is perpendicular relative to the axis of revolution C-C of the object 8, in order to orientate the generating line 14 of the conical portion 9 parallel with the printing screen 12 in a position which is illustrated in FIG. 2.

The retention and locking system 28 allows the orientation of the motor/step-down motor assembly to be modified and fixed and thus the orientation of the object 8 carried thereby in accordance with the angle of conicity a of the object.

The retention and locking system 28 comprises two upper pulling members 30, 32 which extend through two holes of the housing 26 and which are engaged in the motor/step-down motor assembly 27, and two lower pulling members 34, 36 which extend and can be moved through a cam 38 in the form of an arc of a circle centred on the axis A-A.

Each pulling member 30, 32, 34, 36 is provided with a locking/unlocking handle in order to fix the orientation of the drive device 6 and thus retain the face of the object 8 to be printed parallel with the screen 12.

Figure 3:
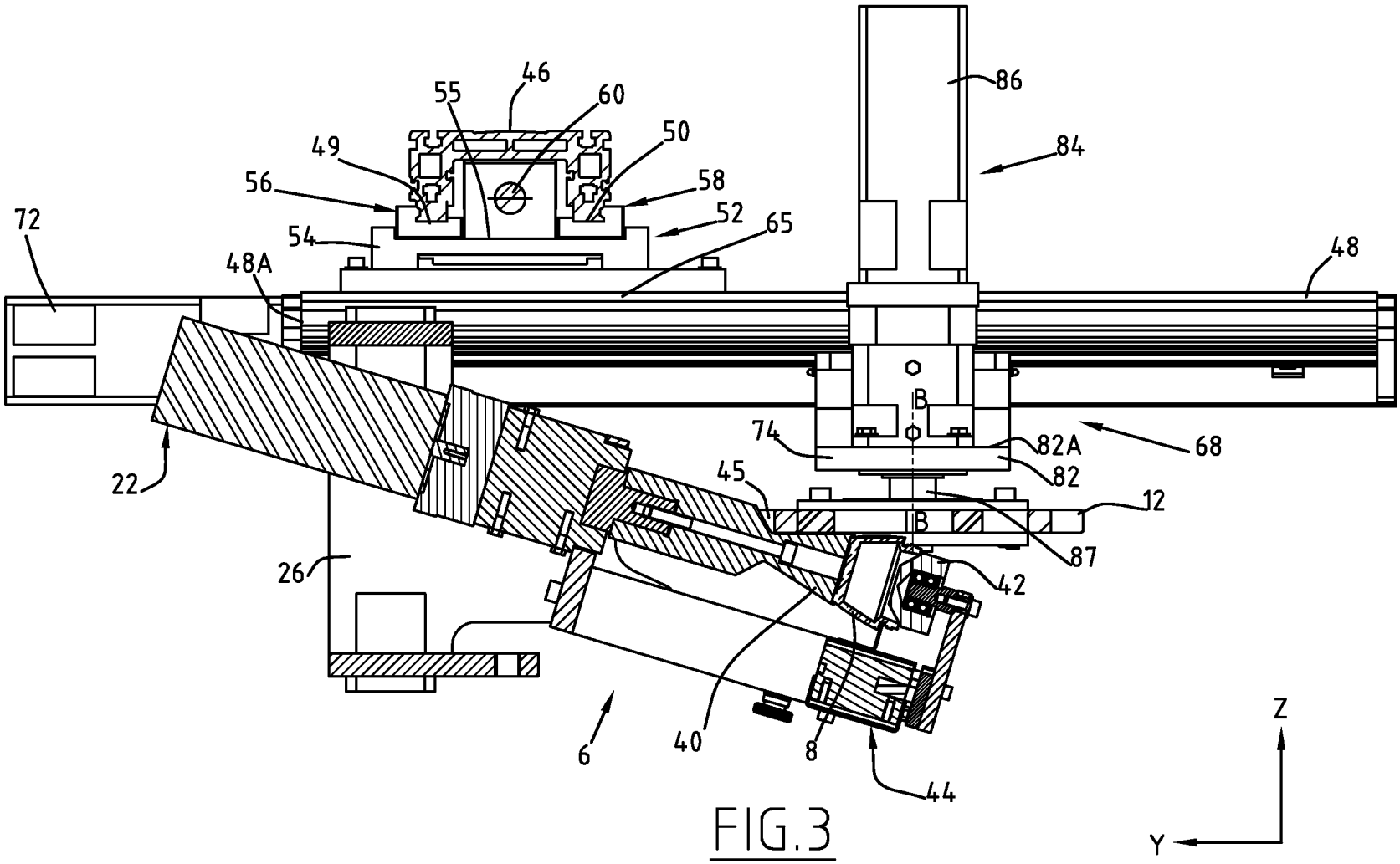
FIG. 3 is a sectioned view of the printing device along the line III-III illustrated in FIG. 1.
Figure 4:
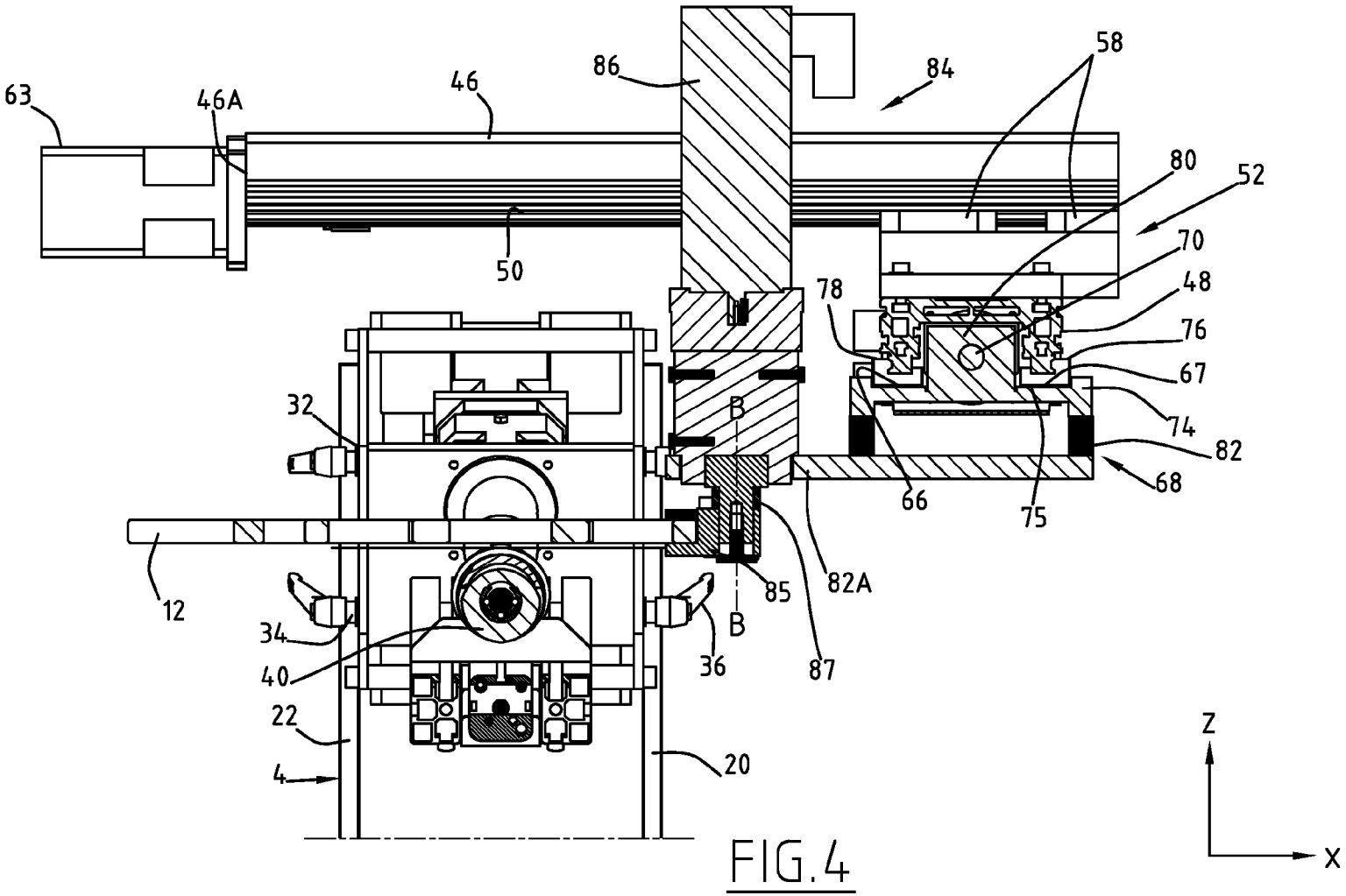
FIG. 4 is a sectioned view of the printing device along the line IV-IV illustrated in FIG. 1.

As can be seen in FIG. 3, the object 8 to be printed is retained between a base 40 which delimits a shape outline which complements the shape of the base of the object 8 and a tip 42 for retaining the neck of the object 8 which is arranged opposite the base 40.

The base 40 is fixed to the output shaft of the motor/step-down motor assembly 27. The tip 42 is capable of being moved towards and away from the front face 16 of the frame 4 in order to axially clamp the object 8 between the base 40 and the tip 42. To this end, a pneumatic jack 44 for moving the tip is fixed to the motor/step-down motor assembly 27. The base 40 further has a recess 45 in order to allow the screen 12 to rotate.

The system 10 for moving the screen 12 comprises a first elongate profile-member 46 which is fixed with one of the ends thereof to the upper face of the frame 4 and a second elongate profile-member 48 which is carried by the first profile-member.

The first profile-member 46 has a cross-section in the form of an inverted U-shape. It is provided with two slotted members 49, 50 which extend parallel with the longitudinal axis of the profile-member 46, that is to say, parallel with the axis X-X at a Cartesian reference point (X, Y, Z) which is fixed relative to the frame 4 which is illustrated in FIG. 1.

A first carriage 52 is guided on the slotted members 49, 50. As can be seen in FIG. 3, the first carriage 52 comprises a support plate 54 whose upper face 55 is provided with two pairs of sliding members 56, 58 which are engaged in the slotted members 49, 50 and a bearing which co-operates with an endless screw 60.

The endless screw 60 is fixedly joined to an output shaft of a single motor 63 which is capable of movably driving the first carriage 52 on the slotted members 49, 50.

The slotted members 49, 50, the sliding members 56, 58, the bearing and the endless screw 60 form a reversible mechanical connection between the motor 63 and the first carriage 52.

The motor 63 is fixed to a lateral face 46A of the first profile-member 46. It is reversible and indexed to an encoder 64 which is illustrated schematically in FIG. 1. The motor 63 comprises means for interrupting the electrical power supply thereof.

The encoder 64 is capable of reading the co-ordinates (O, X) of the position of the first carriage 52 at a Cartesian reference point (X, Y, Z) when the carriage is driven by the motor or when it is moved manually by an operator.

The second profile-member 48 is fixed to the lower face 65 of the support plate 54 of the first carriage. It extends parallel with the axis Y-Y at the Cartesian reference point (X, Y, Z).

The second profile-member 48 is identical to the first profile-member 46.

In this manner, the second profile-member 48 is also provided with two slotted members 66, 67 which extend along the longitudinal axis thereof and on which a second carriage 68 is guided by an endless screw 70. The endless screw 70 is rotatably driven by a single motor 72 which is fixed to a lateral face 48A of the second profile-member 48.

The motor 72 is reversible and is indexed to an encoder 73 which is schematically illustrated in FIG. 1. The motor 72 comprises means for interrupting the electrical power supply thereof.

The encoder 73 is capable of reading the position coordinates (Y, O) of the second carriage 68 at the Cartesian reference point (X, Y, Z) when the second carriage 68 is driven by the motor 72 or when it is manually moved by an operator.

The second carriage 68 is similar to the first carriage 52. It is constituted by a support plate 74 which has an upper face 75 which is fixedly joined to two pairs of sliding members 76, 78 which are engaged in the slotted members 66, 67 and a bearing 80 which co-operates with the endless screw 70.

It further comprises a support 82 which is fixed to the lower face of the support plate 74. A portion of the support 82A extends so as to protrude transversely relative to the support plate 74.

The slotted members 66, 67, the sliding members 76, 78, the bearing 80 and the endless screw 70 form a reversible mechanical connection between the motor 72 and the second carriage 68.

A motor/step-down motor assembly 84 is fixed to the upper face of the support portion 82A so that the output shaft 87 thereof extends along an axis B-B which is parallel with the axis Z-Z of the Cartesian reference point (X, Y, Z). The output shaft 87 extends through an opening which is formed in the support portion 82A. The end thereof is fixed to a pincer 85 for gripping the screen 12.

The motor/step-down motor assembly 84 comprises a single motor 86 which is secured to a step-down mechanism, the assembly being reversible, and indexed to an encoder 87 which is schematically illustrated in FIG. 1. The motor 86 comprises means for interrupting the electrical power supply thereof.

The encoder 87 is capable of reading the rotation angle of the screen 12 at the Cartesian reference point (X, Y, Z) when the screen is driven by the motor 86 or when it is moved manually by an operator.

Figure 5:
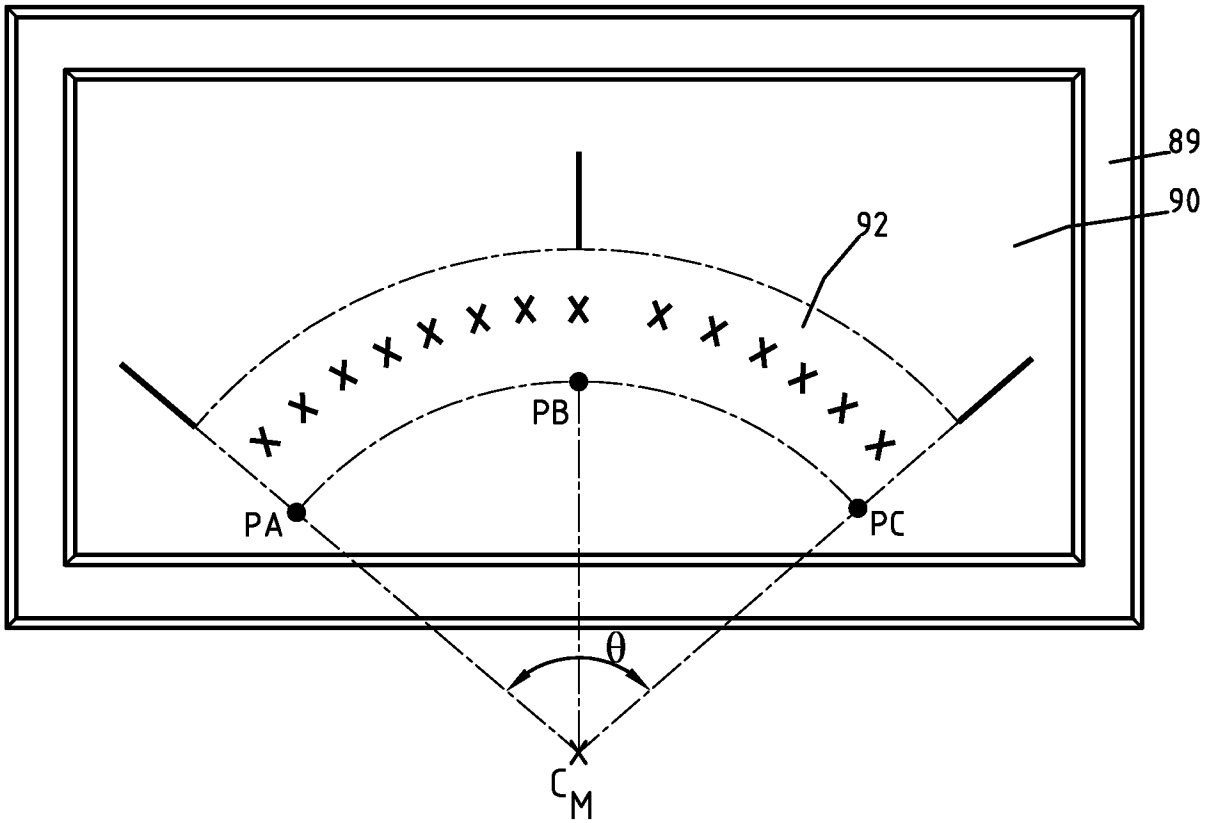
FIG. 5 is a plan view of the screen of the printing device according to the invention.
Figure 6:
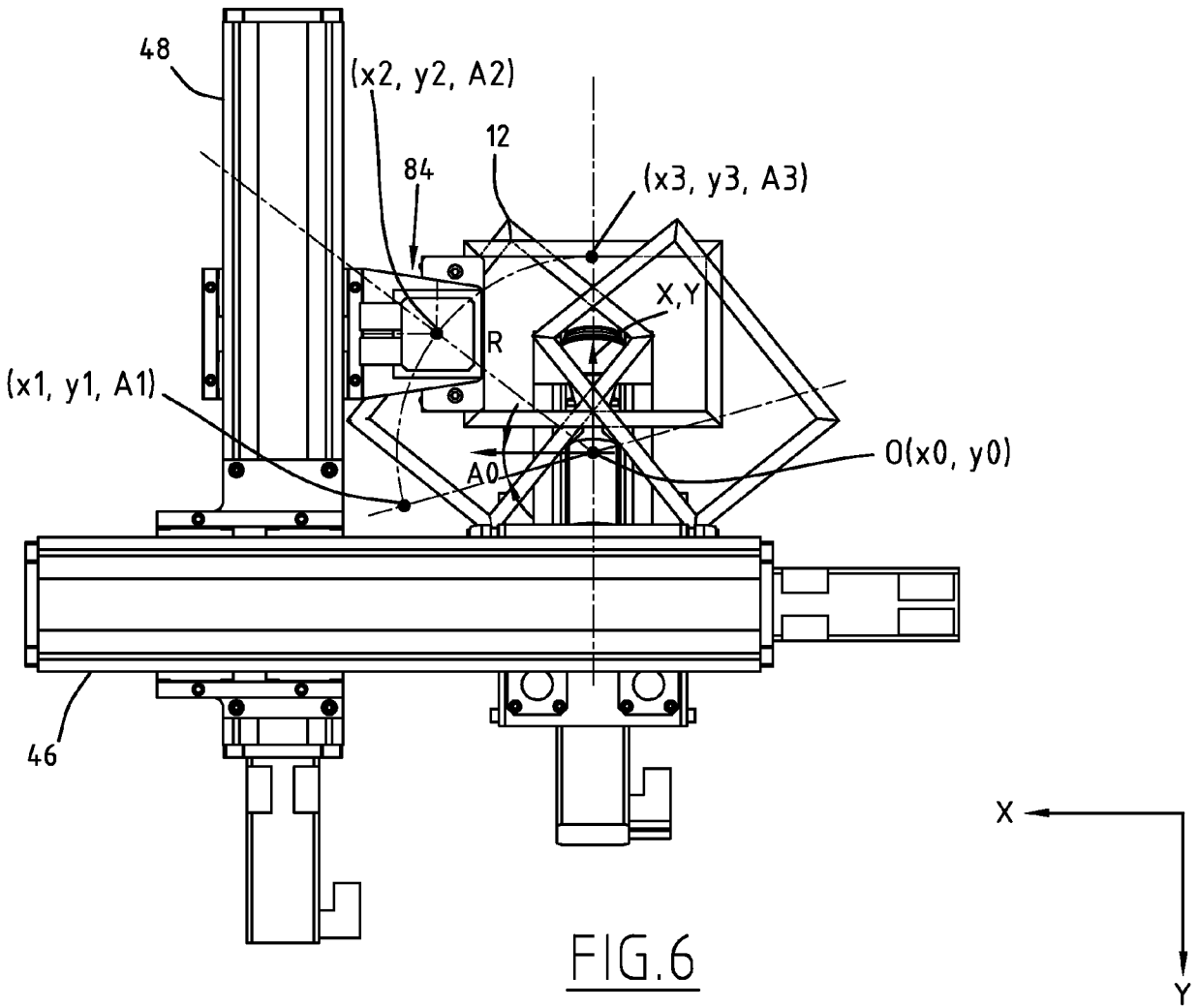
FIG. 6 is a plan view of the printing device according to the invention.
Figure 7:
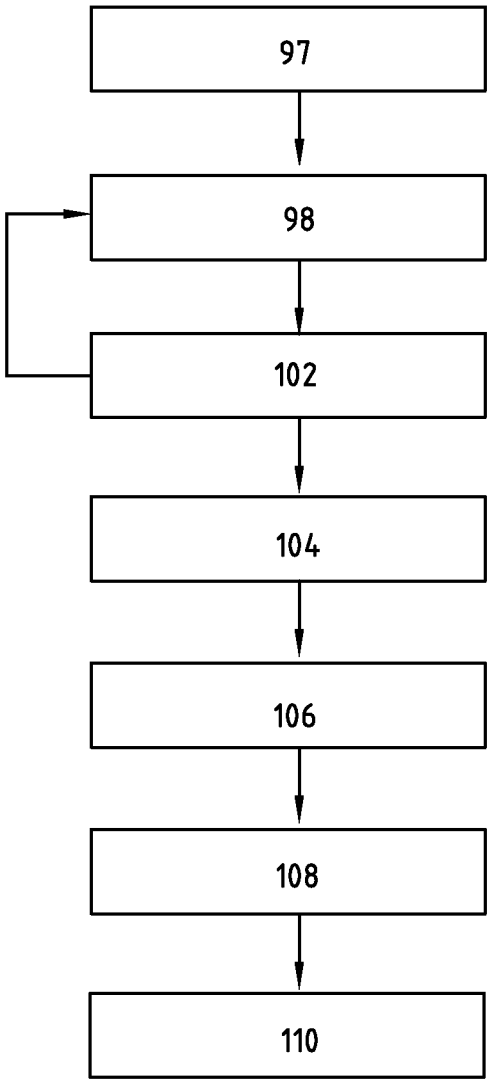
FIG. 7 is a block diagram illustrating the steps of the printing method according to the invention.

The screen 12, which is illustrated in FIG. 5, comprises a frame 89 for retaining a mesh 90 which is fixed to the lower face of the frame 89.

The mesh 90 carries a pattern 92 to be printed which is in the form of a conical evolute. This conical evolute is formed by two arcs of circles having a different radius centred at a point referred to as the centre $C_M$ of the pattern. The two arcs of circles are separated by a distance which corresponds to the height of the pattern. They extend over a width defined by an angular extent range θ of the pattern (in the view, a delta symbol is marked).

The printing device 2 further comprises a squeegee 94 which is illustrated schematically only in FIG. 1. The squeegee 94 is movably driven vertically relative to the frame 4 in order to press the mesh 90 against the conical portion 13 of the object 8 to be printed and thus to press the pattern 92 thereon, the mesh 90 being clamped between the conical portion 13 of the object 8 and the squeegee 94.

The printing device 2 further comprises a control unit 96 which is capable of controlling the motor/step-down motor assemblies 27, 84 and the motors 63, 72 in accordance with the information relating to the angular position of the object, the position of the first carriage 52, the position of the second carriage 68 and the angular position of the screen 12 transmitted by the encoders 23, 64, 73, 87.

The control unit 96 comprises a memory and a processor. The processor is capable of carrying out the instructions of a computer program recorded in the memory.

The program is capable of implementing instructions in order to carry out a method for adjusting the printing device and a printing method described above.

In order to print the pattern 92 on the generating line 14 of the conical portion of the object, the screen 12 must be positioned relative to this object so that the centre $C_M$ of the pattern is located at the intersection point of a plane containing the mesh 90 and the axis of revolution C-C of the object, in a position illustrated in FIG. 2.

Then, the output shaft 87 of the drive motor 86 of the screen must pivot about this intersection point, referred to below as the centre of rotation of the screen O(x0, y0), the centre of rotation O(x0, y0) intersecting with the centre $C_M$ of the pattern.

The method for adjusting the printing device is intended to define the successive coordinates X(t), Y(t) of the first carriage 52 and the second carriage 68 and the successive rotation angles A(t) of the screen 12 about the centre of rotation O(x0, y0).

The method for adjusting the printing device begins with a learning phase which comprises a step 97 for adjusting the vertical position of the drive device 6 relative to the frame 4 and a step for adjusting the orientation of the motor/step-down motor assembly 27 relative to the housing 26.

To this end, the housing 26 is moved on the vertical rails 20, 22, 24 until the conical portion 13 of the object is remote from the screen 12 by a distance of from 0 to a few millimeters.

The motor/step-down motor assembly 27 is pivoted about the axis A-A in order to arrange the generating line 14 of the object 8 horizontally and parallel with the mesh of the screen 12, as illustrated in FIG. 2. The orientation of this assembly 27 is fixed using the cam locking and retention system 28.

During a step 98, the user superimposes a portion of the pattern located at one end thereof relative to the object 8.

To this end, the electrical power supplies of the motors 63, 72, 86 are interrupted and an operator moves the first carriage 52 along the slotted members 48, 50, the second carriage 68 along the slotted members 66, 67 and the screen 12 about the axis B-B in order to position the portion of the pattern to be printed on the object.

When the first carriage 52 and second carriage 68 and the screen 12 are positioned, the user activates the control unit 96 during a step 102 so that it reads and records at the Cartesian reference point (X, Y, Z) the position coordinates (x1, O) of the first carriage 52 and the coordinates (O, y1) of the second carriage 68 and the orientation angle A1 of the screen 12.

The steps 98 and 102 are repeated for a portion located at the other end of the pattern, the control unit 96 recording the position coordinates (x2, y2) of the first carriage 52 and second carriage 68 and the orientation angle A2 of the screen 12.

The steps 98 and 102 are also repeated for a third portion of the pattern 92 located between the two ends of the pattern, the control unit 96 recording the position coordinates (x3, y3) of the first carriage 52 and second carriage 68 and the orientation angle A3 of the screen 12.

If the coordinates (x1, y1), (x2, y2) and (x3, y3) merge, the output shaft 87 of the motor 86 is located at the centre of rotation O(x0, y0).

If the coordinates (x1, y1), (x2, y2) and (x3, y3) are in alignment, the pattern 92 to be printed is intended to be printed on a cylindrical object.

In order to carry out the steps 98 and 102, the user may, for example, identify on the mesh 90 of the screen an initial point PA which is located at an initial end of the pattern 92, a final point PC which is located at a final end of the pattern 92 and an intermediate point PB which is located between the initial point PA and the final point PC, the points PA, PB and PC being inscribed along an arc of a circle centred on the centre $C_M$ of the pattern. Then, the screen 12 is moved in order to place the initial point PA and the centre $C_M$ of the pattern in a vertical plane which contains the axis of revolution C-C of the object, and the coordinates (x1, y1, A1) are then recorded. The carriages 52, 68 and the screen 12 are moved in the same manner in order to record the coordinates (x2, y2, A2) which are obtained when the intermediate point PB and the centre $C_M$ of the pattern are placed in a vertical plane containing the axis of revolution C-C and the coordinates (x3, y3, A3) obtained when the initial point PA and the centre $C_M$ of the pattern are positioned in a vertical plane containing the axis of revolution C-C.

The method for adjusting the printing device continues with a calculation phase which involves a step 104 during which the control unit 96 calculates the coordinates (x0, y0) of the centre of rotation O of the output shaft 87 of the motor 86 at the Cartesian reference point (X, Y, Z) and the radius R of rotation of the output shaft 87 about this centre (x0, y0).

The coordinates (x0, y0) of the centre of rotation O are obtained from the coordinates (x1, y1), (x2, y2) and (x3, y3). A single circle extends through these three coordinates.

The radius R of rotation of the output shaft 87 of the motor 86 is obtained based on the following formula:

$$R=\sqrt{(x0-x1)^2\pm(y0-y1)^2}$$

where:

x0 and y0 are the coordinates of the centre of rotation of the output shaft 87 at the Cartesian reference point (X, Y, Z), x1, y1 are position coordinates of the first carriage and the second carriage recorded when the initial portion of the pattern 92 is superimposed at the conical position.

During a step 106, the control unit 96 successively calculates the position of the first carriage and the position of the second carriage at the Cartesian reference point (X, Y, Z) based on the following formulae:

$$X(t)=x0+R\times\cos\,[(A(t)-A1)+A0]$$

$$Y(t)=y0+R\times\sin\,[(A(t)-A1)+A0]$$

where:

X(t), Y(t) are the coordinates of the first carriage 52 and the second carriage 68 at the Cartesian reference point (X, Y, Z) at the time t, t being varied over time, all the coordinates X(t), Y(t) calculated from different times t defining the movement path of the first carriage 52 and the second carriage 68, x0 and y0 are the coordinates of the centre of rotation of the output shaft 87 of the motor 86 at the Cartesian reference point (X, Y, Z), R is the rotation radius of the output shaft 87 of the motor 86 about the centre of rotation O(x0, y0), A0 is the angle of orientation of the screen 12 defined between the axis X of the Cartesian reference point (X, Y, Z) and the straight line which extends through the coordinates (x1, y1) and the coordinates O(x0, y0), A(t) is the angle of rotation of the screen 12 at time t, A being varied over time over an angular sector which is equal to the angular sector of the angular extent range (θ) of the pattern, A(t=0) is equal to the angle A1 minus any overtravel angle prior to printing, A(t=(t end)) is equal to the angle A3 plus any overtravel angle after printing, A1 is the angle of orientation of the screen 12 recorded when the portion located at the initial end of the pattern is superimposed over a part of the conical portion 13 which is intended to receive this portion of the pattern, and A3 is the angle of orientation of the screen 12 recorded when the portion located at the final end of the pattern is superimposed over a part of the conical portion 13 which is intended to receive this portion of the pattern.

The first carriage 52 and the second carriage 68 are moved over a path whose length depends only on the position of the centre of conicity $C_c$ of the conical portion 13 of the object and the angular extent range θ of the pattern.

During a step 108, the control unit 96 calculates the angular rotation range of the screen about the output shaft 87. This is equal to the angular extent range θ of the pattern. Then, the unit calculates the angles of rotation A(t) of the screen over time.

The angular rotation speed $W_E$ of the screen 12 is a function of the angular rotation speed $W_o$ of the object 8 of the angle of conicity a of the object 8. In particular, the rotation speed $W_E$ of the screen 12 is obtained based on the following formula:

$$W_E = W_O \times \tan(\alpha)$$

where:

$W_o$ is the angular rotation speed of the object about the axis C-C, and $W_E$ is the angular rotation speed of the screen about the axis B-B.

The printing method according to the invention involves the steps of the adjustment method followed by a step 110 for printing the objects for which the printing device has been adjusted.

During the printing operation, the control unit 96 controls the motors 63, 72 and 86 so that the screen is moved in accordance with the successive coordinates X(t), Y(t) calculated during the step 106 and the successive angles of rotation A(t) calculated during the step 108. At the same time, the control unit 96 controls the step-down motor assembly 27 so that the object pivots at an angular speed $W_O$.

In a variant, it is possible to use a pattern which has already been printed beforehand on the object in order to record the co-ordinates (x1, y1, A1), (x2, y2, A2) and (x3, y3, A3). In this instance, the user superimposes the pattern of the screen over three different portions of the pattern which has already been printed on the object.

Advantageously, the printing device according to the invention allows a clearance angle of 360° for the screen 12. When the pattern extends over the entire periphery of the object, the rotation axis of the rotation shaft 87 is positioned close to the centre $C_M$ of the pattern.

What is claimed is:

1. A device for printing by means of screen printing an object having at least a conical portion, the conical portion having a conical centre and a cone angle, the device comprising:

a frame;

a mobile screen relative to the frame, the screen having a mesh with a pattern to be printed on the conical portion of the object, the pattern having the shape of a conical evolute having a pattern centre and an angular extent range of the pattern;

a squeegee which is carried by the frame, the squeegee being capable of pressing the mesh of the screen against the conical portion of the object in order to apply the pattern to the conical portion of the object, wherein the device comprises:

a driving means for rotating the screen around an axis of rotation, said driving means for rotating the screen comprising a single motor, a first displacement means of the motor for rotating the screen during the printing of the object, said first displacement means extending in a first direction, a second displacement means of the motor for rotating the screen during the printing of the object, said second displacement means extending in a second direction perpendicular relative to the first direction, the first displacement means carrying the second displacement means, wherein, the squeegee is i) independent from the driving means for rotating the screen, and ii) independent from the first and second displacement means of the motor for rotating the screen, so that i) the screen and not the squeegee is moved by the motor and by the first and second displacement means, and ii) the squeegee is movable independently from the screen relative to the frame.

2. The printing device according to claim 1, wherein the first displacement means comprise a first slotted member which is fixedly joined to the frame and a first carriage which is guided in the first slotted member, the second displacement means comprising a second slotted member which is carried by the first carriage and a second carriage which is guided in the second slotted member, the second carriage carrying the means for rotatably driving the screen.

3. The printing device according to claim 2, wherein the first displacement means and the second displacement means each comprise a single motor for movably driving the first carriage and second carriage, respectively.

4. The printing device according to claim 3, further comprising:

a reversible mechanical connection between the motor for movably driving the first carriage and the first carriage, and a reversible mechanical connection between the motor for movably driving the second carriage and the second carriage.

5. The printing device according to claim 2, wherein the single motor of the driving means for rotating the screen rotates in a first rotation direction and an opposite second rotation direction; and the motors of the first and second displacement means each drive in a first movement direction and an opposite second movement direction.

6. The printing device according to claim 2, wherein the first carriage and the second carriage are moved over a path whose length depends only on the position of the centre of conicity of the conical portion of the object and the angular extent range of the pattern.

7. The printing device according to claim 2, wherein the first displacement means and second displacement means are capable of allowing the first carriage and the second carriage to be moved manually relative to the frame in the first direction and second direction, respectively, the means for rotatably driving the screen are capable of allowing the screen to pivot manually about the rotation axis, further comprising:

means for reading the position of the first carriage, the position of the second carriage and the rotation angle of the screen at a Cartesian reference point which is fixed relative to the frame, calculation means which are capable of calculating, from the positions read, the coordinates of the movement path of the first carriage and the second carriage and the rotation angles of the screen at the Cartesian reference point, and control means which are capable of controlling the movement of the first carriage, the second carriage and the rotation of the screen in accordance with the coordinates and the angles calculated.

8. A method for adjusting a printing device according to claim 7, further comprising:

a) a learning phase which involves the following steps:

moving the first carriage and the second carriage in the first direction and the second direction, respectively, and causing the screen to pivot in order to superimpose a portion of the pattern over part of the conical portion;

reading the position coordinate of the first carriage, the position coordinate of the second carriage and the orientation angle of the screen at the Cartesian reference point, the learning phase being carried out for three different parts of the pattern;

b) a phase for calculating the coordinates of the movement path of the first carriage and the second carriage from the coordinates and the angles read during the learning phase.

9. An Adjustment method according to claim 8, wherein, during the learning phase, an initial point, a final point and an intermediate point are defined, the initial point being located at an initial end of the pattern, the final point being located at a final end of the pattern, the intermediate point being located between the initial end and final end of the pattern, the three points extending along an arc of a circle centred on the centre of the pattern, and the first carriage and second carriage and the screen are moved so as to arrange the centre of the pattern and a defined point in a vertical plane which contains the axis of revolution of the object.

10. Adjustment method according to claim 8, wherein the calculation phase involves the following steps:

calculating the coordinates of the centre of rotation of the output shaft of the motor for rotatably driving the screen at the Cartesian reference point and the radius of rotation of the output shaft of the motor for rotatably driving the screen about this centre of rotation;

calculating the coordinates of the movement path of the first carriage and the second carriage at the Cartesian reference point based on the following formulae:

$$X=x0+R\times\cos[-A1)+A0]$$

$$Y=y0+R\times\sin[-A1)+A0]$$

where:

X(t), Y(t) are the coordinates of the movement path of the first carriage and the second carriage at the Cartesian reference point, t being varied over time, x0, y0 are the coordinates of the centre of rotation of the output shaft of the motor for rotatably driving the screen at the Cartesian reference point, R is the radius of rotation of the output shaft of the motor for rotatably driving the screen about the centre of rotation O, A0 is the angle defined between the axis X of the Cartesian reference point and a straight line which extends through the centre of rotation O and the coordinates, A(t) is the angle of rotation of the output shaft of the drive motor at time t, with A being varied over time over an angular sector which is equal to the angular sector of the angular extent range of the pattern, and A1 is the angle of orientation of the screen recorded when a portion located at an initial end of the pattern is superimposed over a part of the conical portion which is intended to receive the pattern.

11. The method for adjusting a printing device according to claim 8, further comprising:

a step for printing the object.

12. The printing device according to claim 1, further comprising:

a reversible mechanical connection positioned between i) the single motor of the driving means for rotating the screen and ii) the screen.

13. The printing device according to claim 1, further comprising:

means for rotatably driving the object relative to the frame at a predefined angular speed and the motor for rotatably driving the screen is capable of causing the screen to pivot at an angular speed which is dependent only on the angle of conicity of the object and the angular rotation speed of the object.

14. The printing device according to claim 1, wherein, the driving means moves the screen in rotation and in translation while the squeegee remains still such that during the printing of the object the orientation of the screen relative to the squeegee changes in order to print the object having the at least a conical portion.

15. A device for printing by means of screen printing an object having at least a conical portion, the conical portion having a conical center and a cone angle, the device comprising:

a frame;

a mobile screen relative to the frame, the screen having a mesh with a pattern to be printed on the conical portion of the object, the pattern having the shape of a conical evolute having a pattern center and an angular extent range of the pattern;

a squeegee which is carried by the frame, the squeegee being capable of pressing the mesh of the screen against the conical portion of the object in order to apply the pattern to the conical portion of the object, wherein the device comprises:

a driving means for rotating the screen around an axis of rotation, said driving means for rotating the screen comprising a single motor, a first displacement means of the motor for rotating the screen during the printing of the object, said first displacement means extending in a first direction, a second displacement means of the motor for rotating the screen during the printing of the object, said second displacement means extending in a second direction perpendicular relative to the first direction, the first displacement means carrying the second displacement means, wherein the first displacement means comprise a first slotted member which is fixedly joined to the frame and a first carriage which is guided in the first slotted member, the second displacement means comprising a second slotted member which is carried by the first carriage and a second carriage which is guided in the second slotted member, the second carriage carrying the means for rotatably driving the screen, and wherein the first displacement means and second displacement means are capable of allowing the first carriage and the second carriage to be moved manually relative to the frame in the first direction and second direction, respectively, the means for rotatably driving the screen are capable of allowing the screen to pivot manually about the rotation axis, further comprising:

means for reading the position of the first carriage, the position of the second carriage and the rotation angle of the screen at a Cartesian reference point which is fixed relative to the frame, calculation means which are capable of calculating, from the positions read, the coordinates of the movement path of the first carriage and the second carriage and the rotation angles of the screen at the Cartesian reference point, and control means which are capable of controlling the movement of the first carriage, the second carriage and the rotation of the screen in accordance with the coordinates and the angles calculated.

16. A method for adjusting a printing device according to claim 15, further comprising:

a) a learning phase which involves the following steps:

moving the first carriage and the second carriage in the first direction and the second direction, respectively, and causing the screen to pivot in order to superimpose a portion of the pattern over part of the conical portion;

reading the position coordinate of the first carriage, the position coordinate of the second carriage and the orientation angle of the screen at the Cartesian reference point, the learning phase being carried out for three different parts of the pattern;

b) a phase for calculating the coordinates of the movement path of the first carriage and the second carriage from the coordinates and the angles read during the learning phase.

17. An Adjustment method according to claim 16, wherein, during the learning phase, an initial point, a final point and an intermediate point are defined, the initial point being located at an initial end of the pattern, the final point being located at a final end of the pattern, the intermediate point being located between the initial end and final end of the pattern, the three points extending along an arc of a circle centered on the center of the pattern, and the first carriage and second carriage and the screen are moved so as to arrange the center of the pattern and a defined point in a vertical plane which contains the axis of revolution of the object.

18. Adjustment method according to claim 16, wherein the calculation phase involves the following steps:

calculating the coordinates of the center of rotation of the output shaft of the motor for rotatably driving the screen at the Cartesian reference point and the radius of rotation of the output shaft of the motor for rotatably driving the screen about this center of rotation;

calculating the coordinates of the movement path of the first carriage and the second carriage at the Cartesian reference point based on the following formulae:

$$X=x0+R\times\cos[-A1)+A0]$$

$$Y=y0+R\times\sin[-A1)+A0]$$

where:

X(t), Y(t) are the coordinates of the movement path of the first carriage and the second carriage at the Cartesian reference point, t being varied over time, x0, y0 are the coordinates of the center of rotation of the output shaft of the motor for rotatably driving the screen at the Cartesian reference point, R is the radius of rotation of the output shaft of the motor for rotatably driving the screen about the center of rotation O, A0 is the angle defined between the axis X of the Cartesian reference point and a straight line which extends through the center of rotation O and the coordinates, A(t) is the angle of rotation of the output shaft of the drive motor at time t, with A being varied over time over an angular sector which is equal to the angular sector of the angular extent range of the pattern, and A1 is the angle of orientation of the screen recorded when a portion located at an initial end of the pattern is superimposed over a part of the conical portion which is intended to receive the pattern.

19. A screen printing device to screen printing an object having at least a conical portion, the conical portion having a conical center and a cone angle, the device comprising:

a frame (4);

a driving device (6) carried by the frame (4) and movable relative to the frame (4), the driving device configured to rotatably drive an object (8) to be printed;

a mobile printing screen (12), the screen having a mesh with a pattern to be printed on the conical portion of the object, the pattern having the shape of a conical evolute having a pattern center and an angular extent range of the pattern;

a rotation system (10) to rotate the printing screen (12) relative to the frame (4);

a squeegee which is carried by the frame, the squeegee configured to press the mesh of the screen against the conical portion of the object in order to apply the pattern to the conical portion of the object, wherein, the rotation system (10) is configured to rotate the screen around an axis of rotation, said rotation system (10) comprising a single motor, with i) a first displacement part of the motor rotating the screen during the printing of the object, said first displacement part extending in a first direction, and ii) a second displacement part of the motor rotating the screen during the printing of the object, said second displacement part extending in a second direction perpendicular relative to the first direction, the first displacement part carrying the second displacement part, wherein, the squeegee moves i) independent from the rotation system, and ii) independent from the first and second displacement parts of the motor for rotating the screen, so that i) the screen and not the squeegee is moved by the motor and by the first and second displacement parts, and ii) the squeegee is movable independently from the screen relative to the frame, only the screen being moved in rotation and in translation relative to the frame during printing of the object.

20. The printing device of claim 19, wherein, during printing of the object, the rotation system moves the screen in rotation and in translation while the squeegee remains still such that during the printing of the object the orientation of the screen relative to the squeegee changes in order to print the object.

* * * * *